US005220861A

United States Patent [19]

Kamimura

[11] Patent Number: 5,220,861

[45] Date of Patent: Jun. 22, 1993

[54] ACTUATOR WITH NEUTRAL POSITION RETURN

[75] Inventor: Toshio Kamimura, Gifu, Japan

[73] Assignee: Teijin Seiki Co., Ltd., Osaka, Japan

[21] Appl. No.: 835,375

[22] Filed: Feb. 14, 1992

[30] Foreign Application Priority Data

Feb. 15, 1991 [JP] Japan ..... 3-42896

[51] Int. Cl.[5] ..... F15B 20/00; F15B 13/04; F15B 11/08

[52] U.S. Cl. ..... 91/360; 91/392; 91/410; 91/459; 91/467; 91/468

[58] Field of Search ..... 91/358 R, 360, 388, 91/392, 410, 459, 462, 467, 468; 60/403, 406

[56] References Cited

U.S. PATENT DOCUMENTS

| | | | |
|---|---|---|---|
| 2,346,418 | 4/1944 | Dodson | 91/360 |
| 2,352,470 | 6/1944 | Carlton | 91/410 X |
| 3,468,126 | 9/1969 | Mercier | 91/388 X |
| 3,583,285 | 6/1971 | Johnson | 91/388 |
| 4,936,196 | 6/1990 | Kamimura et al. | 91/360 |
| 4,953,445 | 9/1990 | Kervagoret et al. | 91/358 R X |

FOREIGN PATENT DOCUMENTS

| | | |
|---|---|---|
| 297802 | 5/1988 | Japan . |
| 308204 | 12/1988 | Japan . |
| 266308 | 10/1989 | Japan . |
| 113101 | 4/1990 | Japan . |

*Primary Examiner*—Edward K. Look
*Assistant Examiner*—John Ryznic
*Attorney, Agent, or Firm*—Rothwell, Figg, Ernst & Kurz

[57] ABSTRACT

The mechanism has an actuator provided with a piston, a servo control valve which is actuated by electric input and output signals for supplying working fluid to the actuator and exhausting working fluid from the actuator, a slider which closes an oil passage from the servo control valve to the actuator and which temporarily engages with the piston of the actuator via a link mechanism, when a system for transmitting the input and output signals or the servo control valve breaks down, and a centering valve which is constructed in one body with the slider and which stops supply and exhaust of working fluid after the actuator has been returned to its neutral position by supply of working fluid to the actuator when a system for transmitting the input and output signals or the servo control valve breaks down.

2 Claims, 8 Drawing Sheets

ACTUATOR WITH NEUTRAL POSITION RETURN

BACKGROUND OF THE INVENTION

The present invention relates to a mechanism for returning to a neutral position of an actuator. The present invention relates to a mechanism for returning a servo actuator, used in equipment, such as an aircraft, which especially requires high safety, to its neutral position when electric system for input and output signals breaks down.

In general, an aircraft requires high safety. In order to meet with this requirements, an aircraft is generally provided with two or more control systems for one object to be controlled so that a flight can be continued by using the remaining control system even when one of the control systems breaks down.

Even in this case, if the broken down control system maintains the condition under which the breakdown has occurred, the operation by the remaining control system may be obstructed, and accordingly, the safety of flight may be endangered. Thus, in such a case, it is necessary for the broken down control system to be returned to its neutral position wherein the flight is not adversely influenced upon by the broken down control system.

Mechanisms for returning a servo actuator, which controls wing, to its neutral position upon its breakdown have been conventionally proposed. Such conventional mechanisms for returning to the neutral position are roughly classified into two basic groups.

In the first group, as disclosed in Japanese Patent Laid-open No. Sho 63-297802, No. Hei 1-266308, and No. Hei 2-113101, the servo control valve is forcedly actuated upon breakdown so as to return the actuator to its neutral position.

In the second group, as disclosed in Japanese Patent Laid-open No. 63-308204, the passage in the servo control valve is closed upon breakdown, and a centering valve which is additionally disposed is actuated so as to return the actuator to its neutral position.

However, these conventional mechanisms for returning neutral position have the following disadvantages. More specifically, in the mechanisms belonging to the first group, the servo control valves per se have to be specially designed and accordingly, commercially available servo control valves cannot be used therefor. Thus, their manufacturing cost is expensive.

Contrary to this, in the mechanisms belonging to the second group, a directional control valve or a stop valve has to be disposed between the mechanism for returning to neutral position and the actuator. Accordingly, the hydraulic circuit becomes complicated and the size of the mechanism becomes large, and accordingly, their manufacturing cost is also expensive.

In addition, it is necessary for the mechanisms of the second group to be provided with a plurality of restrictor check valves so as to prevent a runaway of the actuator, i.e., a condition wherein the piston of the actuator moves to the operating end at a stretch, or an uncontrollable condition of the actuator upon switching from a normal condition to a breakdown condition or from a breakdown condition to a normal condition. However, in actual usage, although the runaway speed can be reduced, occurrence of such a runaway or an uncontrollable condition cannot be completely prevented.

Further, when, for example, the mechanism is applied to a mechanism for operating a steering flap of an airplane, it is preferred from an operational point of view that it initially moves slowly upon return to the neutral position, it gradually increases its speed and then it stops at the neutral position. However, because of the construction as described above, the moving speed of the actuator is slow since the restrictor check valve is disposed in the return oil passage from the centering valve, and accordingly, the actuator cannot be returned quickly to the neutral position.

SUMMARY OF THE INVENTION

The present invention has been achieved so as to obviate the above-described disadvantages.

It is an object of the first aspect of the present invention to make a hydraulic circuit simple by omitting use of a flow directional valve or a stop valve.

It is an object of the second aspect of the present invention to provide a mechanism by which the above-described requirement regarding operability can be achieved by disposing a flow control valve in place of a plurality of restrictor check valves.

According to the first aspect of the present invention, a mechanism for returning to a neutral position of an actuator is provided, which comprises:

- an actuator provided with a piston as an output means;
- a servo control valve which is actuated by electric input and output signals for supplying working fluid to the actuator and exhausting working fluid from the actuator;
- a slider which closes an oil passage from the servo control valve to the actuator and which temporarily engages with the piston of the actuator via a link mechanism, when a system for transmitting the input and output signals or the servo control valve breaks down; and
- a centering valve which is constructed in one body with the slider and which stops supply and exhaust of working fluid after the actuator has been returned to its neutral position by supply of working fluid to the actuator when a system for transmitting the input and output signals or the servo control valve breaks down.

According to the second aspect of the present invention, a mechanism for returning to a neutral position of an actuator is provided, which comprises:

- an actuator provided with a piston as an output means;
- a servo control valve which is actuated by electric input and output signals for supplying working fluid to the actuator and exhausting working fluid from the actuator;
- a slider which temporarily engages with the piston of the actuator via a link mechanism;
- a centering valve means which stops supply and exhaust of working fluid after the actuator has been returned to its neutral position by supply of working fluid to the actuator when a system for transmitting the input and output signals or the servo control valve breaks down; and
- a fluid control valve for time sequentially suppressing exhaust of working fluid from the centering valve means.

BRIEF DESCRIPTION OF THE DRAWINGS

Some embodiments of the present invention will now be explained in detail with reference to the accompanying drawings, wherein.

PREFERRED EMBODIMENTS

Figure 1:
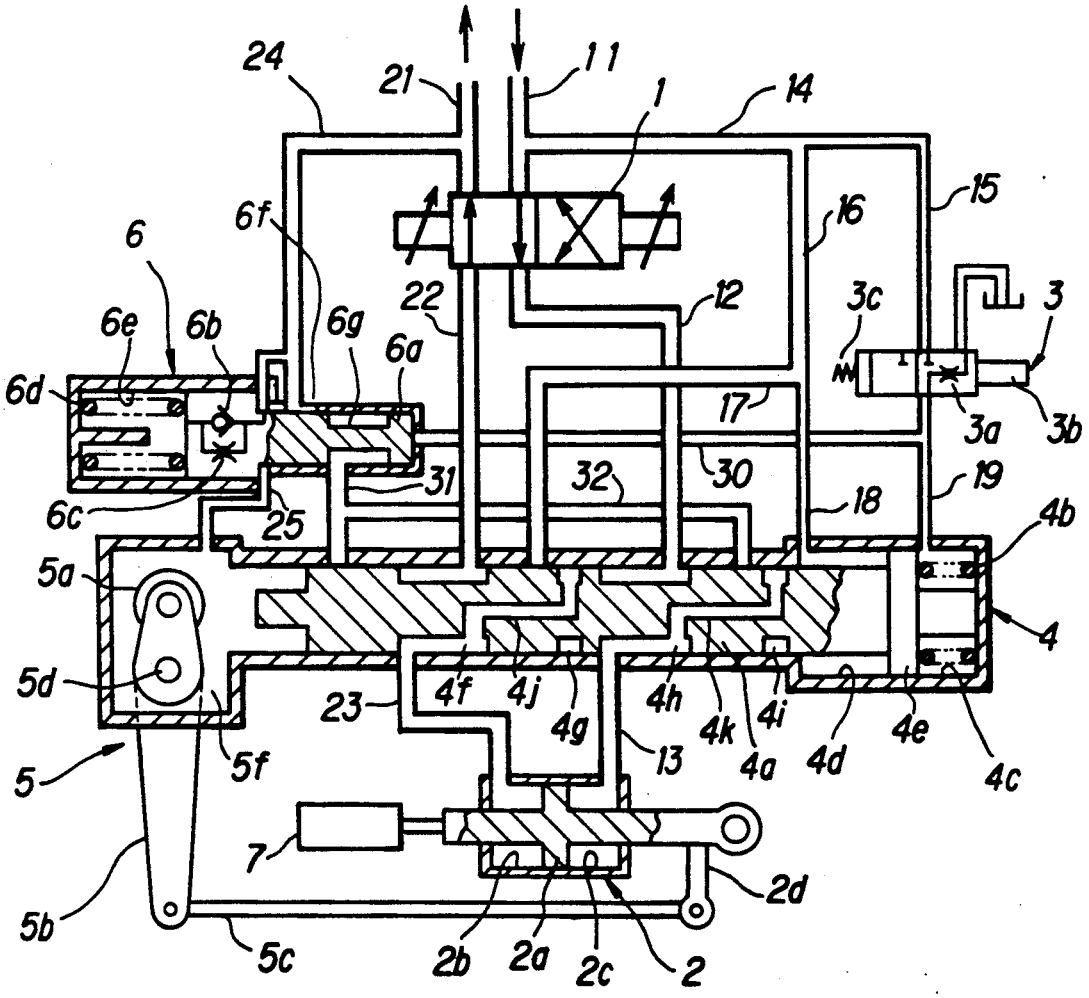
FIG. 1 is a circuit diagram of an embodiment of the present invention in a normal condition.
Figure 2:
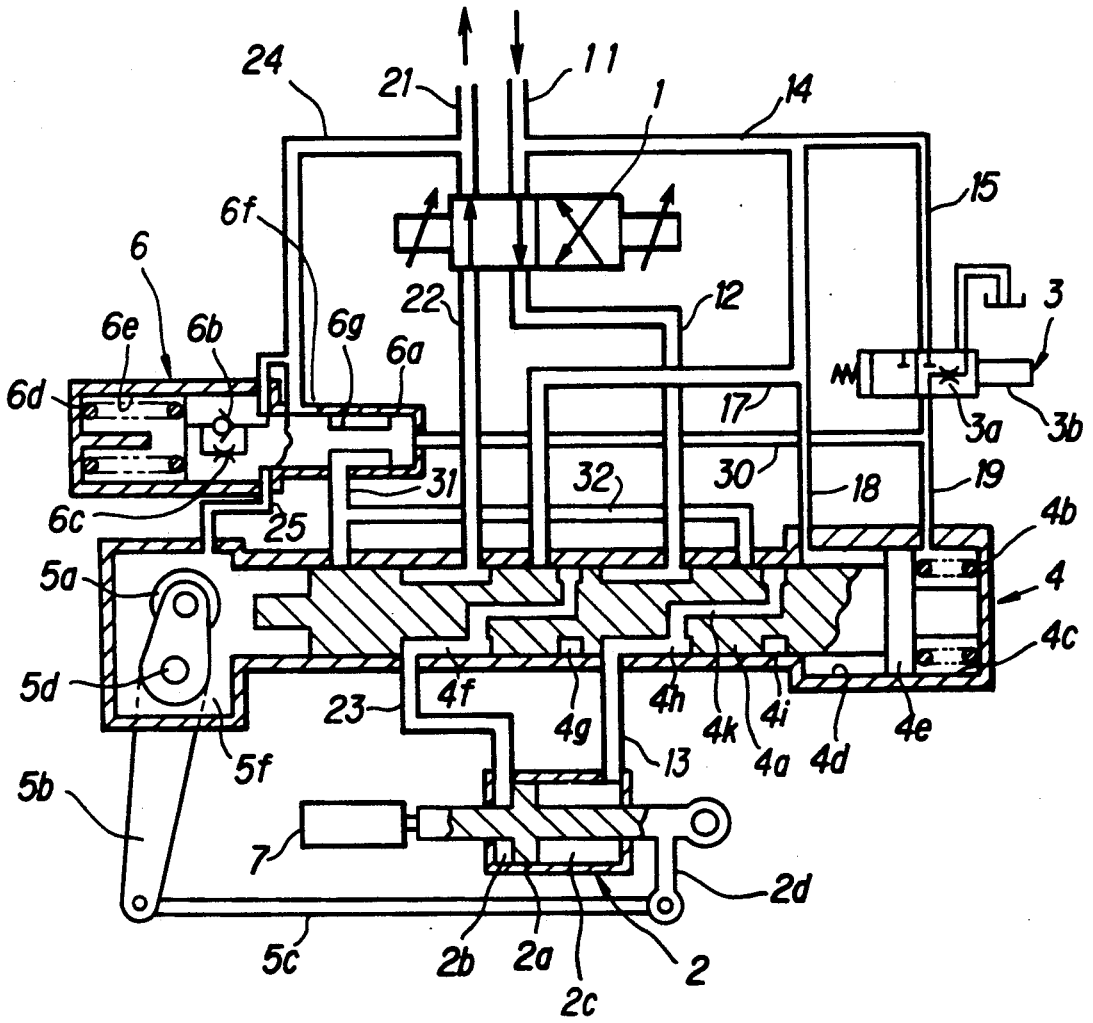
FIG. 2 is a circuit diagram of the embodiment of the present invention in a normal condition.
Figure 3:
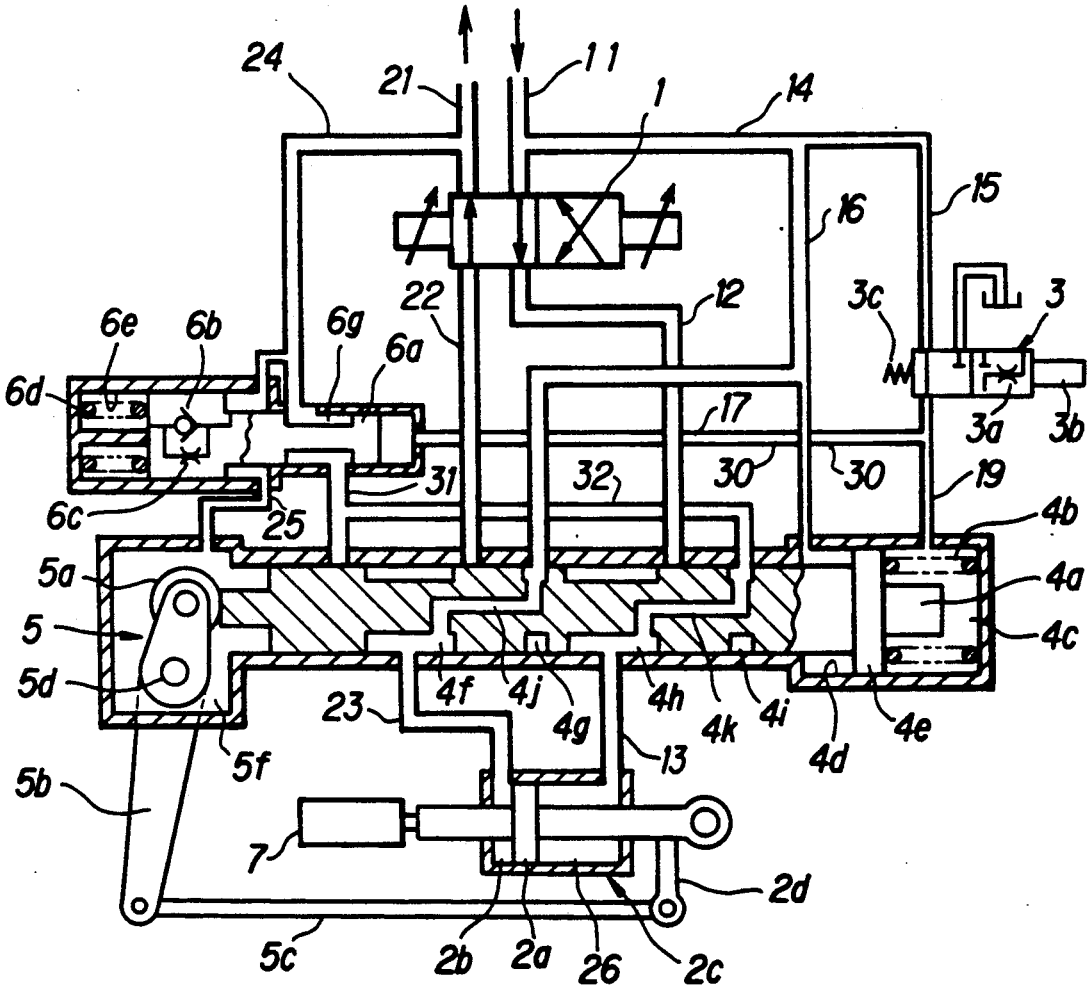
FIG. 3 is a circuit diagram of the embodiment of the present invention in a breakdown condition.
Figure 4:
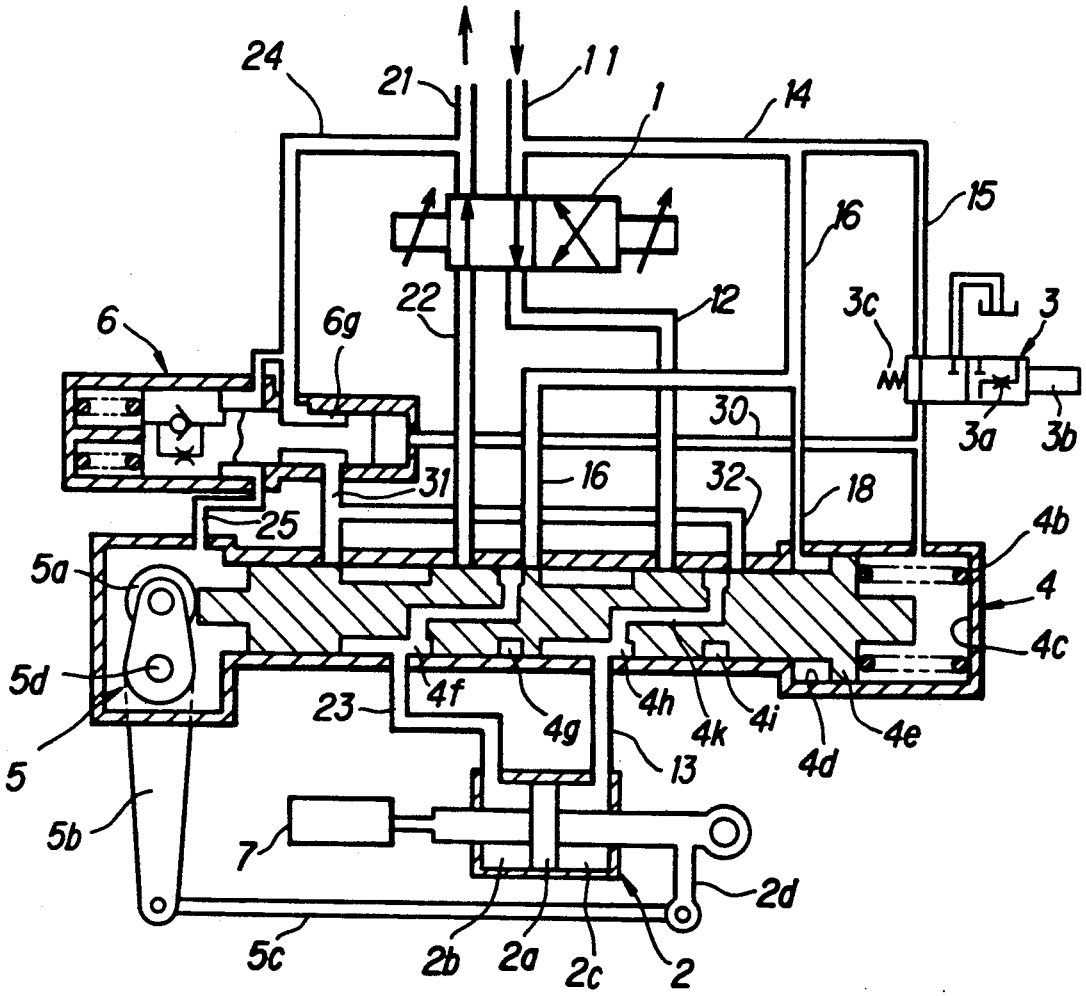
FIG. 4 is a circuit diagram of the embodiment of the present invention in a breakdown condition.
Figure 5:
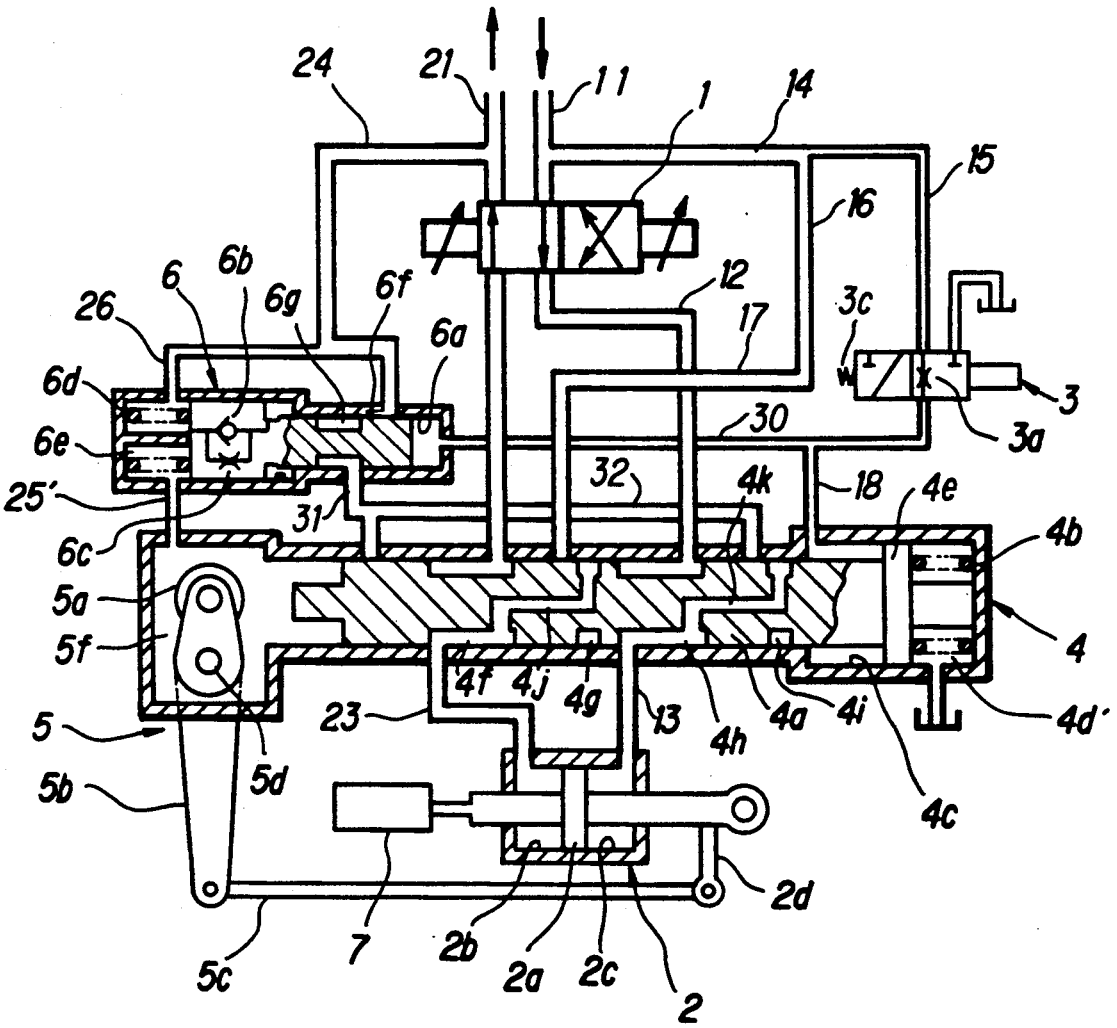
FIG. 5 is a circuit diagram of another embodiment of the present invention in a normal condition.
Figure 6:
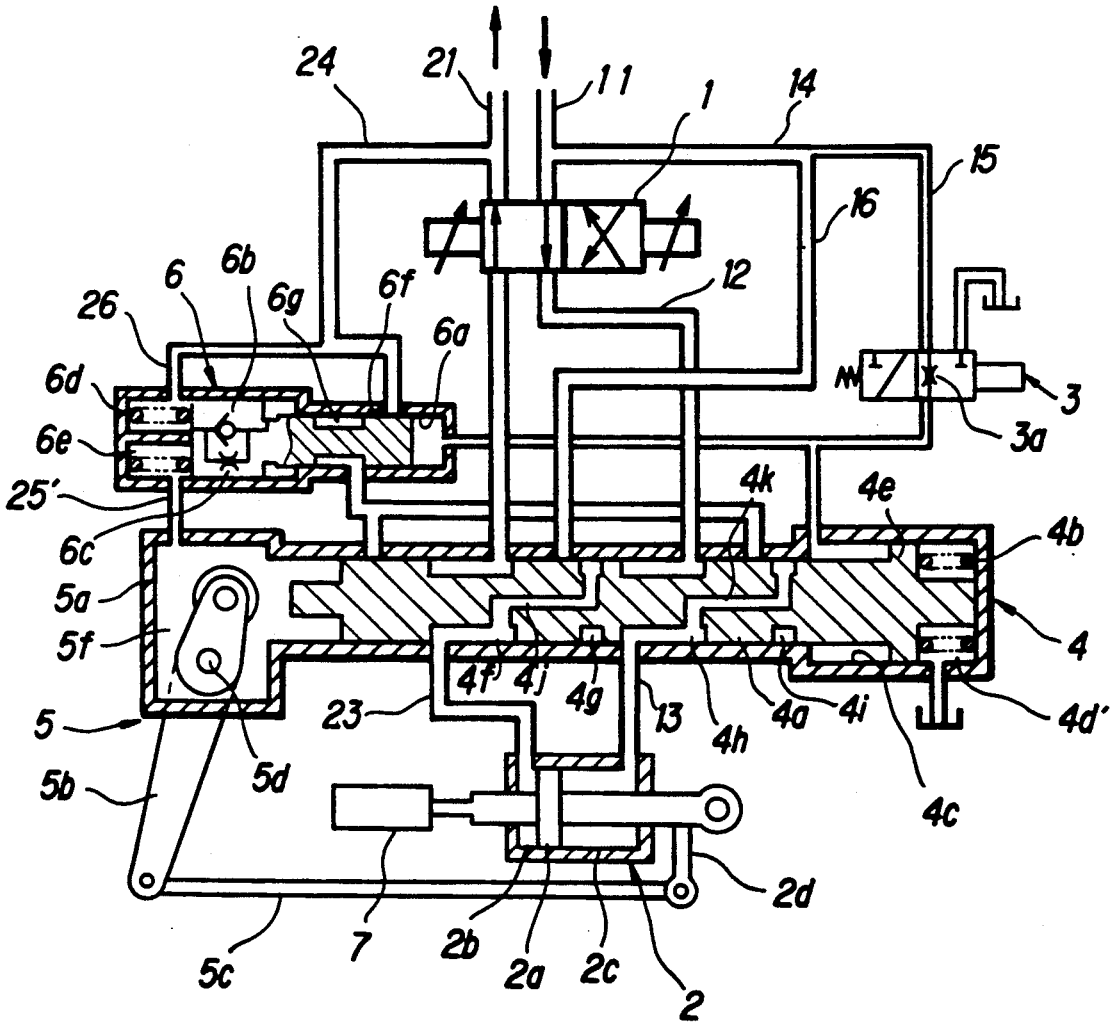
FIG. 6 is a circuit diagram of the other embodiment of the present invention in a normal condition.
Figure 7:
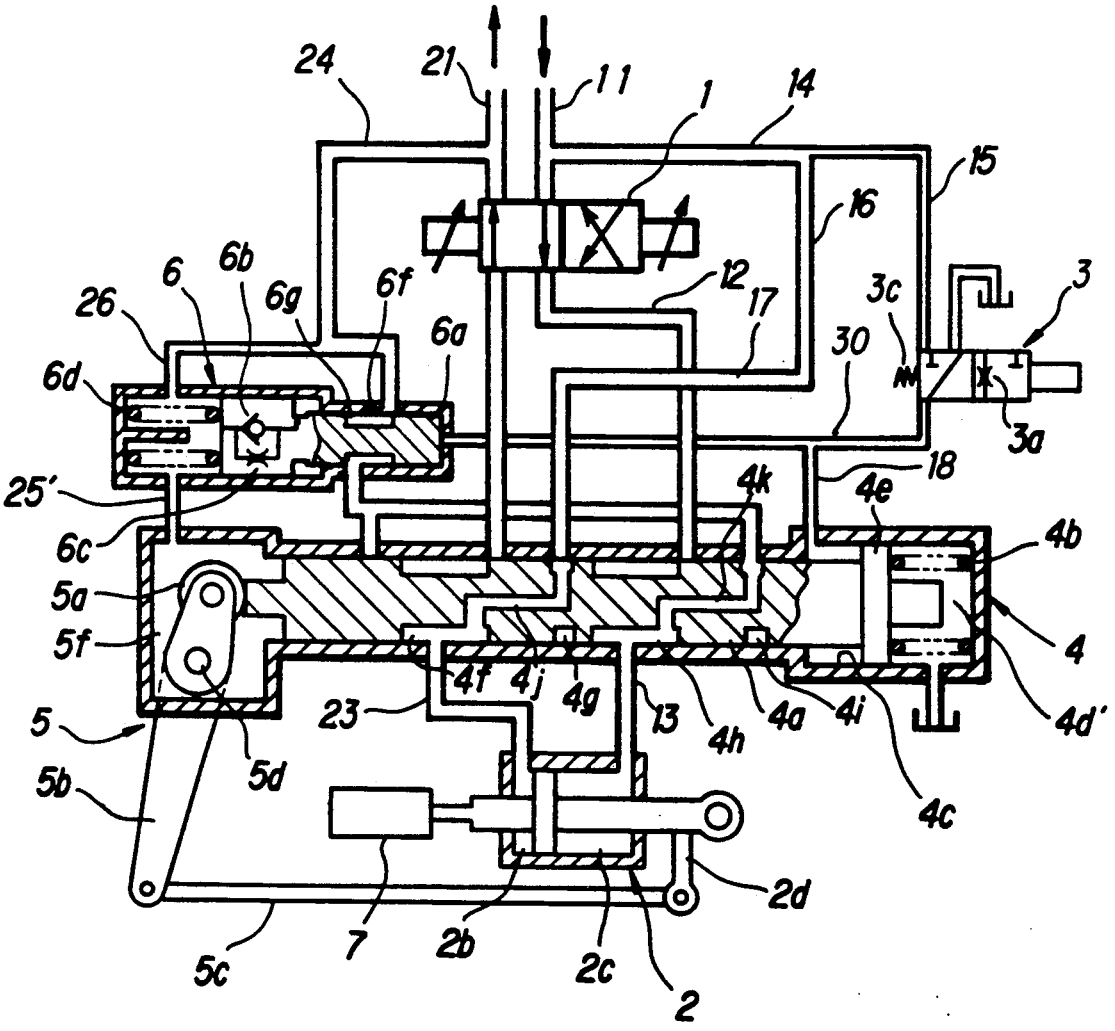
FIG. 7 is a circuit diagram of the other embodiment of the present invention in a breakdown condition.
Figure 8:
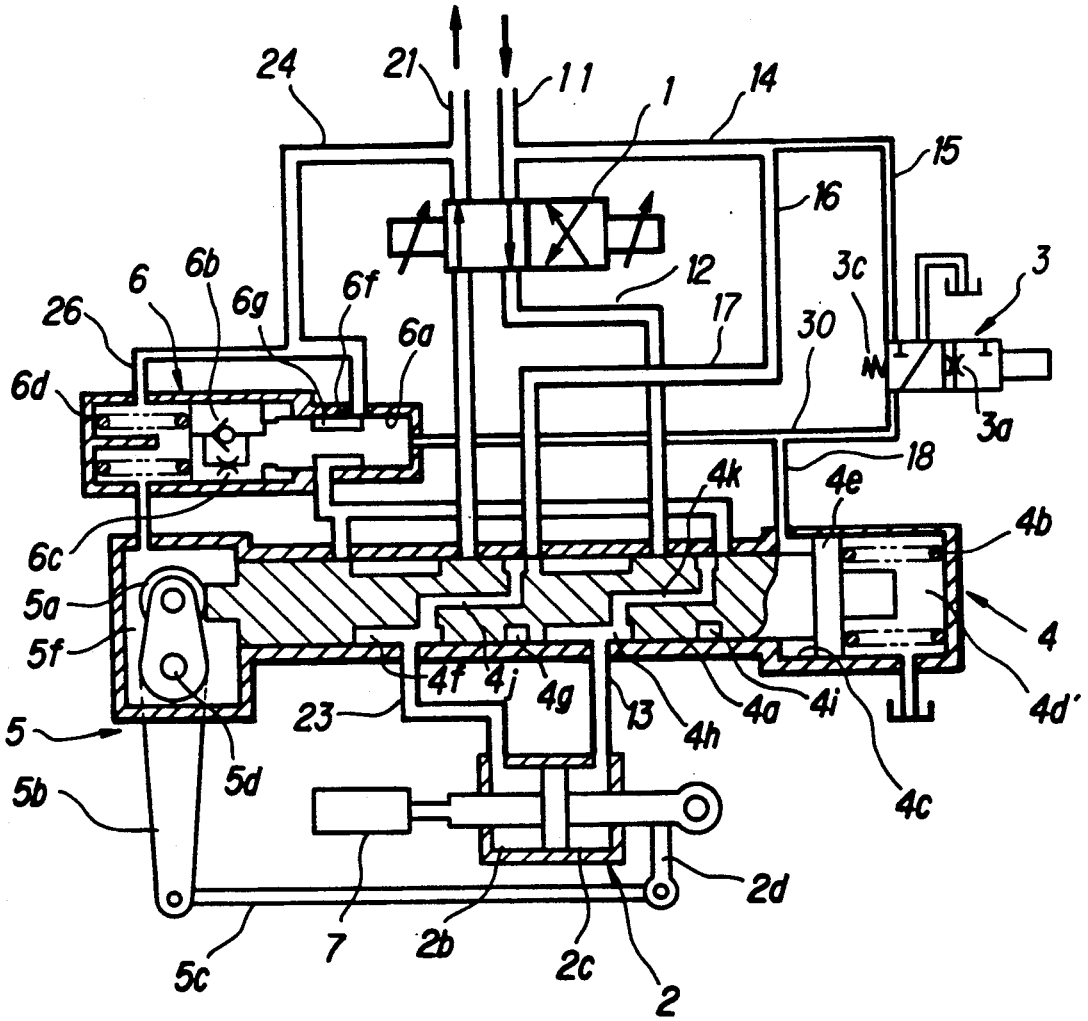
FIG. 8 is a circuit diagram of the other embodiment of the present invention in a breakdown condition.

FIGS. 1 and 2 are circuit diagrams of an embodiment of the present invention in a normal condition, and FIGS. 3 and 4 are circuit diagrams of the embodiment of the present invention in a breakdown condition.

In FIGS. 1 to 4, reference numeral 1 denotes a servo control valve, which is actuated by electric input and output signals so as to supply working fluid to an actuator 2 through supply passages 11, 12 and 13, and a centering valve 4, which will be described later, and to exhaust working fluid from the actuator 2 through exhaust passages 21, 22 and 23. The actuator 2 is provided with pressure receiving chambers 2*b* and 2*c* and a piston 2*a* which is sealingly and slidably inserted into the pressure receiving chambers 2*b* and 2*c*, and it receives pressurized oil from the servo control valve 1 so that the piston 2*a* moves in a horizontal direction within the pressure receiving chambers 2*b* and 2*c*. The left end of the piston 2*a* is connected to a known position sensor 7, which detects the position of the piston 2*a*, and the detected signal is used as a fed-back signal responding to the command signal to the servo control valve 1. The right end 2*d* of the piston 2*a* is integral with and projects from the piston 2*a* to form an L-shape.

The centering valve 4 is disposed between the servo control valve 1 and the servo actuator 2 and is provided with a slider 4*a* which is slidable in a horizontal direction. The slider 4*a* has a plurality of annular recesses 4*f*, 4*g*, 4*h* and 4*i* formed at the periphery thereof and holes 4*j* and 4*k* which communicate the annular recesses 4*f* and 4*g*, and the annular recesses 4*h* and 4*i*. When the slider 4*a* is slid as described later, supply of the pressurized oil to the actuator 2 and exhaust of the pressurized oil from the actuator 2 are controlled.

The right end of the slider 4*a* has a piston portion 4*e*, and the piston portion 4*e* is sealingly slidable within the pressure receiving chamber 4*c*, which receives the pressure from an electro-magnetic valve 3, and the pressure receiving chamber 4*d*, which receives the pressure for pushing back, and it partitions the pressure receiving chambers 4*c* and 4*d*. The electro-magnetic valve pressure receiving chamber 4*c* is communicating with an electro-magnetic valve 3 via a passage 19. The pushing back pressure receiving chamber 4*d* is communicated with supply passage 11, which is upstream of the servo control valve 1, via passages 14, 16 and 18.

A spring 4*b* is disposed within the electro-magnetic pressure receiving chamber 4*c*, which is at the right end of the slider 4, and the spring 4*b* acts on the slider 4*a* to urge the slider 4*a* in a left-hand direction.

A link mechanism 5 is disposed in front of the left end of the centering valve 4, and a lever 5*b* of the link mechanism 5 is pivotable about a pin 5*d* and has a cam roller 5*a* rotatably mounted at the upper end thereof. The lower end of the lever 5*b* has a rod 5*c* pivotably connected thereto, and the right end of the rod 5*c* is pivoted to the L-shaped right end 2*d* of the actuator 2. Due to the above-described construction, when the piston 2*a* of the actuator 2 is moved, the lever 5*b* of the link mechanism 5 is swung about the pin 5*d*. The left end of the slider 4*a* can abut with the cam roller 5*a* of the link mechanism 5 (see FIG. 3). The link mechanism chamber 5*f*, wherein the link mechanism 5 is mounted and which is divided by the end of the slider 4*a* of the centering valve 4, is communicated with the exhaust passage 21 via passages 24 and 25.

The electro-magnetic valve 3 is operated by an electro magnetic solenoid 3*b* under a normal condition, wherein the valve 3 is anti-energized, and is operated by a return spring 3*c* when an input and output signal system or the servo control valve breaks down and the valve 3 is de-energized. When the electro-magnetic valve 3 is operated by the electro-magnetic solenoid 3*b*, the pressurized oil in the electro-magnetic pressure receiving chamber 4*c* of the centering valve 4 is returned to a tank through the passage 19 and a restrictor 3*a* in the electro-magnetic valve 3, while the electro-magnetic valve 3 is operated by the return spring 3*c*, the pressurized oil supplied from the passage 15 is supplied to the electro-magnetic valve pressure receiving chamber 4*c* of the centering valve 4 through the passage 19.

Reference numeral 6 denotes a flow control valve and includes a piston 6*a* which is slidable in a horizontal direction by pressurized oil supplied from the electro-magnetic valve pressure receiving chamber 4*c* through the passage 19, located between the electro-magnetic valve 3 and the actuator 4, and the passage 30. The piston 6*a* has an annular recess 6*g* at the periphery thereof. When the piston 6*a* moves to the left (see FIGS. 3 and 4), the passage 31 and an orifice 6*f* formed at an end of of the passage 24 are communicated with each other via the annular recess 6*g*, and the exhaust port 21 and the centering valve 4 are communicated with each other via the flow control valve 6. The left end of the piston 6*a* faces to a damper chamber 6*e*, which has a spring 6*d* for urging the piston 6*a* to the right mounted therein. The damper chamber 6*e* and the passage 25 are communicated with each other via a check valve 6*b* and a restrictor 6*c*, which are disposed in parallel in the piston 6*a*.

The operation of this embodiment, which is constructed as described above, will now be explained. During the normal operation, which is illustrated in FIGS. 1 and 2, the slider 4*a* of the centering valve 4 is pushed in one direction, i.e., to the right in FIG. 1, to form a flow passage between the servo control valve 1 and the actuator 2, and the actuator 2 is controlled by the servo control valve 1 and remains at a predetermined position.

When control of the servo actuator cannot be carried out due to breakdown of the servo control valve 1 or the electric input and output signal system, the operating position of the electro-magnetic valve 3 is changed by means of the spring 3*c* as illustrated in FIG. 3. As a result, pressurized oil is supplied to the electro-magnetic valve pressure receiving chamber 4c from the supply passage 11 through the electro-magnetic valve 3 and the passage 19 and moves the slider 4a of the centering valve 4 to the left, and accordingly, the passages for communicating the servo valve 1 and the actuator 2 and the passage located between the passages 12 and 13 and the passage located between the passages 22 and 23 are closed. At the same time, the left end of the slider 4a of the centering valve 4 abuts with the cam roller 5a of the link mechanism 5 (see FIG. 3). As a result, passages for returning the piston 2a to its neutral position are formed, i.e., the passages 23 and 16 and the passages 13 and 23 are communicated with each other, and the piston 2a is moved to the neutral position. In this instance, since the lever 5b of the link mechanism 5 and the right end 2d of the piston 2a of the actuator 2 are connected to each other via the rod 5c, the lever 5 of the link mechanism 5 turns in a counter-clockwise direction about the pin 5d. In other words, the cam roller 5a mounted at an end of the lever 5b moves to the left. As a result, slider 4a of the centering valve 4 is also moved to the left together with the movement of the cam roller 5a, and as soon as the piston 2a reaches the neutral position, the passage formed between the passages 23 and 16, and the passage formed between the passages 13 and 23 are closed. Thus, the piston 2a is maintained at the neutral position.

The flow control valve 6 starts its operation by means of the pressurized oil supplied from the passage 30 due to the de-energizing of the electro-magnetic valve 3, when the above-described breakdown occurs. However, at the initial stage, i.e., for the time interval required for switching operation of the centering valve 4, the piston 6a remains at a position similar to that illustrated in FIGS. 1 and 2, and the exhaust passage which extends from the centering valve 4 and which passes through the flow control valve 6, i.e,. the passage formed between the passages 24 and 31, is closed, and thereafter, the passage passing through the flow control valve 6 is gradually increased, and the movement of the piston 2a is gradually sped up from the standstill condition and is moved to the neutral position.

The operation from the breakdown condition to the normal condition is as follows. When the electro-magnetic valve 3 is energized, the electro-magnetic valve pressure receiving chamber 4c of the centering valve 4 and the electro-magnetic valve restrictor 6c of the flow control valve 6 are communicated with the tank through the restrictor 3a disposed in the electro-magnetic valve 3, and the condition illustrated in FIG. 1 takes place.

The spring force of the return spring 6d of the flow control valve 6 and pushing oil pressure (force per unit area) caused in the return pressure receiving chamber 4d and acting against the spring force by the spring 4b of the centering valve 4 are selected as follows. After the exhaust passage formed in the centering valve 4 between the passages 24 and 31 is closed when the flow control valve 6 returns to the normal position, the centering valve 4 closes the passages, i.e., annular recesses 4g and 4i, communicating with the supply passage to the actuator 2 and the exhaust passage from the actuator 2. Thereafter, the passages between the servo control valve 1 and the actuator 2, i.e., the passages formed between the passages 12 and 13, and 22 and 23, are open, and thus, the actuator 2 is prevented from occurring of the runaway upon switching operation and returns to its normal position (see FIG. 1), and the actuator 2 is controlled by the servo control valve 1.

The spring 4b of the centering valve 4 is arranged to prevent the movement of the slider 4a due to vibration upon vacancy of supply hydraulic pressure. In addition, the spring 4b may engage with the link mechanism 5 so that, for example, a check valve (not shown), which may be disposed at the supply passage 11, prevents reverse flow of the hydraulic pressure, and thus, when the piston 2a of the actuator 2 is subjected to an external force, the hydraulic pressure is entrapped so as to prevent the movement of the piston 2a.

Another embodiment will now be explained with reference to FIGS. 5 to 8. Parts similar to those illustrated in the first embodiment are denoted by the same reference numerals, and their detailed explanation is omitted while only the differences are mainly explained.

In the first embodiment, the slider 4a of the centering valve 4 is actuated by the hydraulic pressures acting in the electro-magnetic valve pressure receiving chamber 4c and the pushing back pressure receiving chamber 4d, which chambers are formed at both the sides of the piston portion 4e formed at the right end of the slider 4a. Contrary to this, in the second embodiment illustrated in FIGS. 5 to 8, the movement of the slider 4a to the right is caused by the pressurized oil supplied to the electro-magnetic valve pressure receiving chamber 4c, which is formed on the left hand of the piston portion 4e, from the supply passages 11 through the passages 14, and 15, and the electro-magnetic valve 3, while the movement to the left of the slider 4a is effected by the spring 4b disposed in a spring chamber 4d', which is formed on the right hand of the piston portion 4e. The spring chamber 4d' directly communicates with the tank.

As described above, since the actuation of the centering valve 4 is effected by hydraulic pressure in one direction and by spring force in the other direction, the operation of the electro-magnetic valve 3 in the second embodiment is opposite to that in the first embodiment. More specifically, the electro-magnetic valve 3 supplies hydraulic pressure at the supply passage 11 to the electro-magnetic valve pressure receiving chamber 4c of the centering valve 4 during the normal operation illustrated in FIGS. 5 and 6, while during breakdown condition illustrated in FIGS. 7 and 8 of the electric input and output signal system or the servo control valve 1, the electro-magnetic valve 3 is operated by the spring and the centering valve 4 is not supplied with hydraulic pressure, and the slider of the centering valve 4 is moved to the left by the spring 4b.

The operations of the link mechanism 5 and the servo actuator 2 caused by the movement of the slider 4a of the centering valve 4 are substantially the same as those in the first embodiment.

Further, in the first embodiment, upon breakdown of the electric input and output signal system or the servo control valve 1, the electro-magnetic valve 3 is operated by the spring 3c, wherein the pressurized oil from the supply passage 11 is supplied to the flow control valve 6 through the electro-magnetic valve 3 so that the flow control valve 6 is actuated. However, in the second embodiment, since the operation of the electro-magnetic valve 3 is opposite to that in the first embodiment, the operation of the flow control valve is also reversed. Accordingly, the link mechanism chamber 5f wherein the link mechanism 5 is disposed and the damper chamber 6e are communicated with each other through a passage 25', and at the same time, the damper chamber 6e and the exhaust passage 21 are communicated with each other through the passages 26 and 24. Further, the flow direction of the pressurized oil in the check valve 6b is set to be opposite to that in the first embodiment.

The present invention is constructed in a manner as described above, and accordingly, the present invention is simple in its construction, small in its size and light in its weight, and finally, the manufacturing cost is inexpensive.

Further, according to the second aspect of the present invention, upon switching from the normal condition to the breakdown condition, and vice versa, any runaway of the actuator or any uncontrollable condition of the actuator is completely prevented from occurring, and the returning speed to the neutral position can be set at will.

What we claim is:

1. A mechanism for returning to a neutral position of an actuator comprising:

an actuator provided with a piston as an output means;

a servo control valve which is actuated by electric input and output signals for supplying working fluid to said actuator and exhausting working fluid from said actuator;

a slider which closes an oil passage from said servo control valve to said actuator and which temporarily engages with said piston of said actuator via a link mechanism, when a system for transmitting said input and output signals or said servo control valve breaks down; and a centering valve which is constructed in one body with said slider and which stops supply and exhaust of working fluid after said actuator has been returned to its neutral position by supply of working fluid to said actuator when a system for transmitting said input and output signals or said servo control valve breaks down.

2. A mechanism for returning to a neutral position of an actuator comprising:

an actuator provided with a piston as an output means;

a servo control valve which is actuated by electric input and output signals for supplying working fluid to said actuator and exhausting working fluid from said actuator;

a slider which closes an oil passage from said servo control valve to said actuator and which temporarily engages with said piston of said actuator via a link mechanism;

a centering valve means which stops supply and exhaust of working fluid after said actuator has been returned to its neutral position by supply of working fluid to said actuator when a system for transmitting said input and output signals or said servo control valve breaks down; and a fluid control valve for time sequentially suppressing exhaust of working fluid from said centering valve means.

* * * * *